US008641465B2

(12) United States Patent
Souter

(10) Patent No.: US 8,641,465 B2
(45) Date of Patent: Feb. 4, 2014

(54) APPARATUS FOR WALKING AND RESTING UPON THE WATER

(76) Inventor: Kelly K Souter, Ogden, UT (US)

( * ) Notice: Subject to any disclaimer, the term of this patent is extended or adjusted under 35 U.S.C. 154(b) by 264 days.

(21) Appl. No.: 12/930,647

(22) Filed: Jan. 13, 2011

(65) Prior Publication Data

US 2012/0184163 A1 Jul. 19, 2012

(51) Int. Cl.

| | |
|---|---|
| ***B63B 35/83*** | (2006.01) |
| ***B63B 29/20*** | (2006.01) |
| ***B63B 7/00*** | (2006.01) |

(52) U.S. Cl.

USPC ..... 441/66; 114/364; 114/61.19

(58) Field of Classification Search

USPC ..... 441/38, 40, 76; 114/61.15, 61.17, 362, 114/61.19; 182/70, 95, 115

See application file for complete search history.

(56) References Cited

U.S. PATENT DOCUMENTS

| | | | | | |
|---|---|---|---|---|---|
| 1,533,023 | A | | 4/1925 | Meredith | |
| 3,473,502 | A | * | 10/1969 | Wittkamp | 114/61.23 |
| 3,750,203 | A | * | 8/1973 | Ceccato | 441/76 |
| 4,034,430 | A | | 7/1977 | Joyce | |
| 4,129,912 | A | * | 12/1978 | Robinson | 441/76 |
| 4,915,047 | A | * | 4/1990 | Lord et al. | 114/39.26 |
| 4,952,184 | A | | 8/1990 | Graziano | |
| 5,080,621 | A | | 1/1992 | Nayes | |
| 5,120,249 | A | * | 6/1992 | Fonda | 441/77 |
| 5,421,759 | A | * | 6/1995 | Morin | 441/77 |
| 5,540,178 | A | * | 7/1996 | Damron | 114/362 |
| 5,697,822 | A | * | 12/1997 | Souter | 441/76 |
| 6,131,532 | A | * | 10/2000 | Winner et al. | 114/345 |
| 6,223,678 | B1 | * | 5/2001 | Haller et al. | 114/347 |
| 6,595,813 | B1 | * | 7/2003 | Lekhtman | 440/21 |
| 6,634,914 | B2 | * | 10/2003 | Vancil | 441/40 |
| 2007/0249246 | A1 | * | 10/2007 | Neidert et al. | 441/130 |
| 2011/0303255 | A1 | * | 12/2011 | DeLap et al. | 135/114 |

FOREIGN PATENT DOCUMENTS

| | | | | |
|---|---|---|---|---|
| CA | 736381 | | 6/1966 | |
| DE | 3423422 | | 1/1986 | |
| WO | WO 2008148907 | A2 * | 12/2008 | B63B 7/02 |

* cited by examiner

*Primary Examiner* — Lars A Olson
*Assistant Examiner* — Andrew Polay

(57) ABSTRACT

A water walking apparatus having a pair of inflatable pontoons with footwells at their center, allowing user to step into. The pontoons are connected together by stretch cords and a platform that allows the user to sit and rest after walking on the water. The platform has a ladder inside the cavity of the platform assisting the user to get on the apparatus from water. Pontoons have pockets at bottom for scoops, the scoops pass over water freely when pontoons are going forward, and drop down into water when opposite pontoon is going forward. When scoops are down into water they reduce the backward movement of pontoon. The front ends of pontoons are up and out of water like the bow on a boat. The apparatus can come apart for easy storing and transporting.

16 Claims, 11 Drawing Sheets

PLATFORM SUPPORT (32)

PARTIALLY OPENED

PLATFORM SUPPORT (32)

CUT THROUGH VIEW OF SLIDING & HOLDING PARTIALLY EXTENDED SHOWING STRETCH CORD ATTACHED TO INSIDE SLIDING & HOLDING TUBE

CUT THROUGH VIEW

CUT THROUGH VIEW

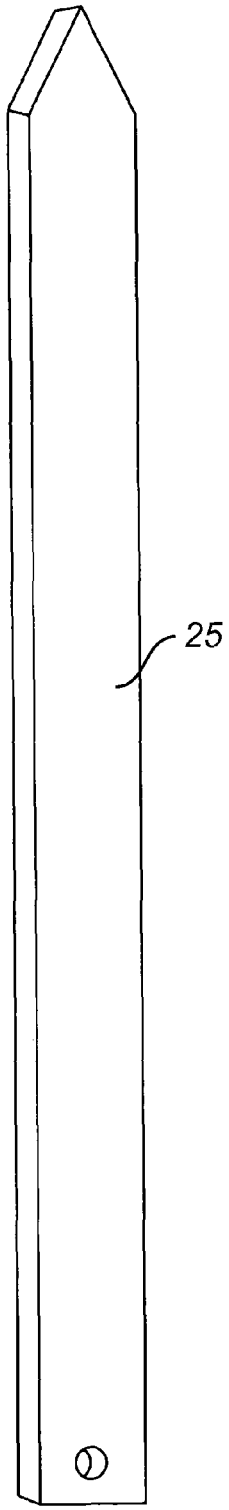
FIG. 18
FIG. 19
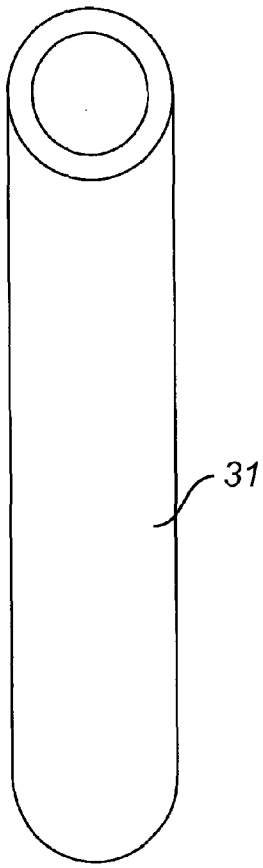

APPARATUS FOR WALKING AND RESTING UPON THE WATER

CROSS-REFERENCE TO RELATED APPLICATIONS

Not Applicable

FEDERALLY SPONSORED RESEARCH

Not Applicable

SEQUENCE LISTING OF PROGRAM

Not Applicable

BACKGROUND OF INVENTION

1. Field of Invention

This invention relates to an apparatus used for walking and resting upon the water, specifically platform stays attached to pontoons while one is walking upon the water, and allows one to sit and rest after walking upon the water.

2. Background of Invention

This apparatus relates to an apparatus allowing a person to walk upon the water. More specifically the invention provides a platform for one to sit and rest on after walking upon the water. The platform also comes with a ladder inside of it, allowing the user to get into and out of the water with the use of ladder. Many types of devices have been proposed in the past which allow a person to walk on a body of water, but there are no other devices with a platform attached to It behind the user while user is walking upon the water, or has a ladder inside platform enabling the user to get back on apparatus if one was to fall in the water. The platform stays attached to the pontoons while one is walking on the water, providing a place to sit and rest or fish after walking upon the water. User can simply stand up and continue to walk upon the water after sitting on platform.

U.S. Pat. No. 4,034,430 is an example of such a water walking device without a platform attached to it while walking. The pontoons in this invention are fabricated from Styrofoam or other similar buoyant materials and the device is also fitted with transverse stabilizers to maintain a fixed relationship between the individual pontoons. The pontoons slide along the transverse stabilizers to maintain their relative positions and the overall result is a cumbersome device U.S. Pat. No. 4,952,184 describes a water walking device also manufactured from a buoyant material such as from rubber or Styrofoam. The user's foot is attached to the top of this device with a foot piece that locks the user's foot to the pontoon. This device also includes rotatable paddles attached to the bottom surface of the pontoon which are allowed to rotate horizontally against the bottom surface of the pontoon.

U.S. Pat. No. 5,080,621 describes a third type of water walking device. This device is manufactured from polyurethane foam or other similar material. It has means for attaching the user's foot in place in the pontoon footwell which includes the use of hook and loop tape or a resilient spring like u-shaped rear ankle support.

U.S. Pat. No. 5,697,822 describes a fourth water walking device that has a pair of buoyant platforms with a pair of sidewalls attached to the top surface of each of the platforms. Removable, inflatable buoyant pontoons are secured to the platforms through flexible sleeves secured to the sidewalls. The pontoons have footwells into which the user inserts his foot, resting the foot on the platform and the foot is secured in place by the addition of the air pressure to the pontoon.

SUMMARY OF INVENTION

The present invention utilizes a number of new approaches of solving the problems that exist in water walking devices. Rather than having the foot held into the footwells, or attached to the top of the pontoons, the footwell is comprised into the inflatable pontoons. The footwell is sealed off at the bottom of pontoon keeping the water from entering into the footwell at the bottom of the footwell. The footwell is large enough for user to insert foot without getting caught up inside footwell. The user can step freely into and out of footwell without getting his shoes caught up inside of the footwell.

It is also an advantage that the narrow support board at the bottom of pontoon gives the pontoon its rigidity, and acts as a keel for pontoon, this gives the user greater stability and easier handling for the apparatus when walking on the water. The support board is designed to be light weight and very strong.

It is also an advantage of present invention to have a platform attached to pontoons when walking upon the water. The platform stays attached to the pontoons directly behind user when user is walking on water, this allows the user to sit and rest after walking on the water. The platform allows the user to stay out on the water for long periods of time, giving the user a place to sit and relax while fishing. One would get very tired of walking on the water after a long period of time. The platform also gives the apparatus more stability than without the platform. The platform allows the user to sit and paddle when desired, then simply stand up and continue to walk. It also is an advantage to have ladder inside platform of apparatus. This allows the user to get into and out of the water as desired. The ladder helps the user get back onto apparatus, specifically if one was to fall off apparatus. This would be a great advantage if someone was to fall into the water, far out off shore, in the middle of a lake, or the ocean.

It is yet another advantage of invention that the scoops that create the resistance for pontoons from going backwards, are attached to the bottom of the pontoons, and go freely over the water when going forward. There are no obstructions extruding from pontoons that would prevent the pontoons from going smoothly over the water. It is yet another advantage that the scoops can be attached and removed from apparatus for easy transportation and storage.

BRIEF DESCRIPTION OF THE DRAWINGS

FIG. 18 shows an upper side view of support board, of present invention.

FIG. 19 shows upper side view of support tube, of present invention.

DETAILED DESCRIPTION OF INVENTION AND PREFERRED EMBODIMENT

Figure 1:
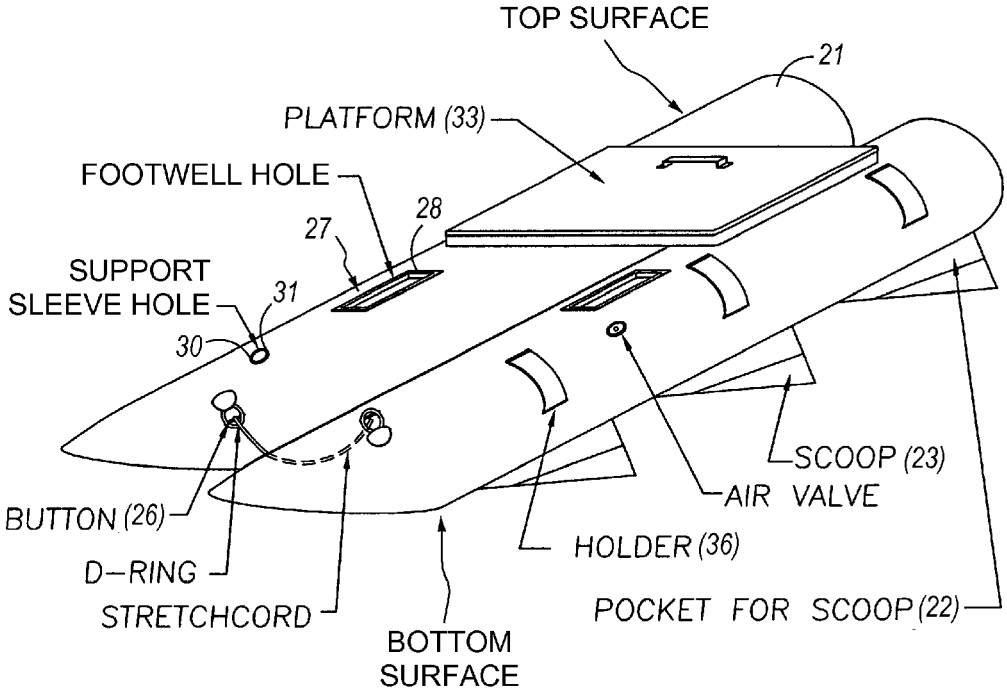
FIG. 1 shows an upper front side view of, apparatus for walking and resting on water, it shows the pontoons, platform, footwells, collars for footwell, air valve, support sleeves, button, stretch cord, holders, pockets for scoops, and scoops of present invention.
Figure 2:
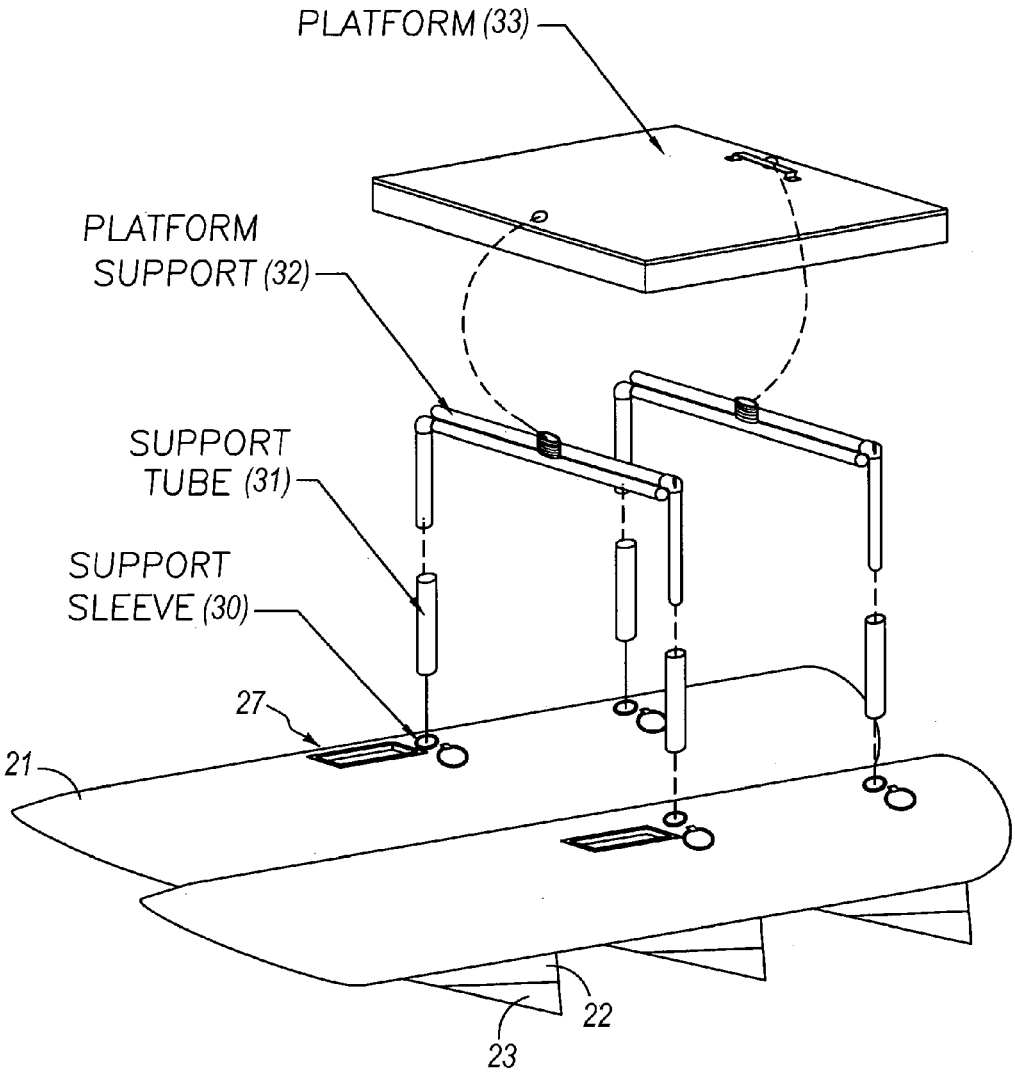
FIG. 2 shows a top side view where the support tubes are inserted into the support sleeves, and how the platform supports are inserted into the support tubes, and where the platform is attached to the necks of the platform supports, of present invention.

FIG. 1 shows a walking version of apparatus. Pontoons 21 are inflatable, lightweight, and compact. Pontoons 21 can be made larger or smaller for different applications. Pontoons 21 can be made out of a high quality reinforced vinyl material. Pontoons 21 can also be made out of a non-reinforced vinyl material. Pontoons 21 are made by heat sealing vinyl material together in the shape of an elongated inflatable pontoon. Pontoons 21 have an air valve sealed to them for the purpose of inflating and deflating. The air valve can be of a high quality air valve designed for inflatable boats, or one designed for inflatable toys. Pontoon 21 has a footwell 27, and support sleeves 30 inside of pontoon 21. Footwell 27 is open at the top and sealed off at the bottom of pontoon 21. Support sleeve 30 is also open at the top and sealed off at bottom of pontoon 21. Pontoons 21 are shown in FIG. 1, and FIG. 2. The average pontoon 21 is approximately eight feet and six inches long, and is twelve inches in diameter. Pontoon 21 can also be comprised smaller or larger. Pontoon 21 has several parts heat sealed to them to be described.

Cover 37 has the same shape of pontoon 21 when pontoon is inflated. Cover 37 can be comprised of a fabric material and come in various designs and colors. Reinforced vinyl material of pontoon 21 would not need to have cover 37. Reinforced vinyl material will not over expand.

Pontoons comprised of a non-reinforced vinyl material will use cover 37 due to the non-reinforced material will expand too much, and would need to have cover 37 to keep from over expanding. Cover 37 also adds protection to pontoons 21 to keep from being punctured. One could also have extra covers 37 for hunting, and fishing, or highly visible bright colored ones. The parts sealed to pontoon 21 would be sewn to covers 37 at their proper position, such as the pockets for scoops 22, board sleeve 24, holders 36, straps for D-rings, and stretch loops 38. These components would be sewn to cover 37 in the same position where they are sealed to pontoon 21.

Figure 12:
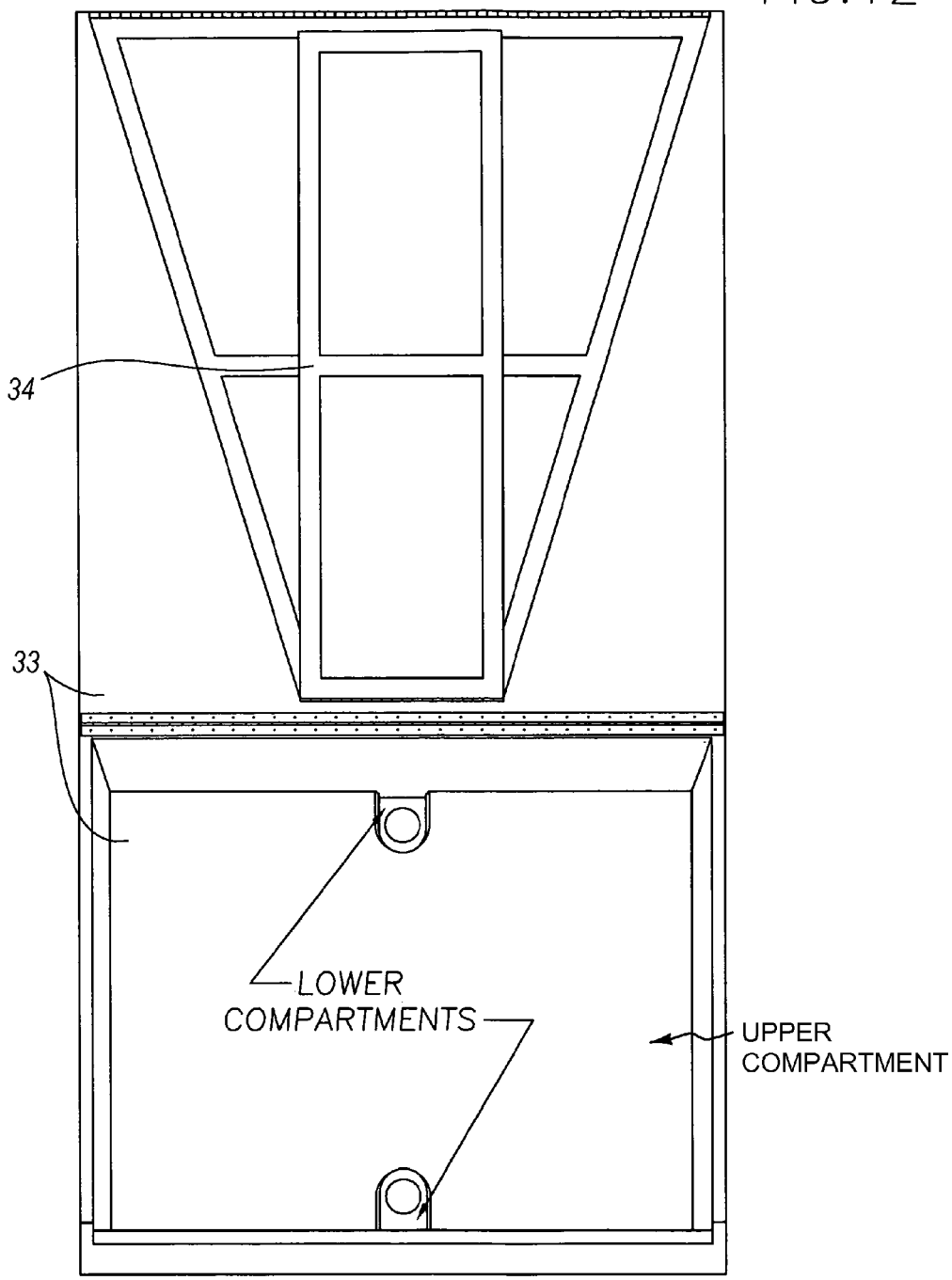
FIG. 12 is an upper rear view of platform with ladder being closed and attached to inside of the top section of platform with platform open, it also shows the lower compartments inside the bottom portion of platform, and the hinges for ladder, of present invention.

FIG. 2 shows how platform 33 is attached to pontoon 21. Support tubes 31 are inserted into the support sleeves 30 of pontoon 21. The legs of platform supports 32 are then dropped into the support tubes 31. The necks of the platform supports 32 are then inserted up into platform 33. FIG. 12 shows lower compartments of platform 33 where ladder 34 is held inside platform. Caps 35 are then screwed onto necks of platform support 32.

Figure 16:
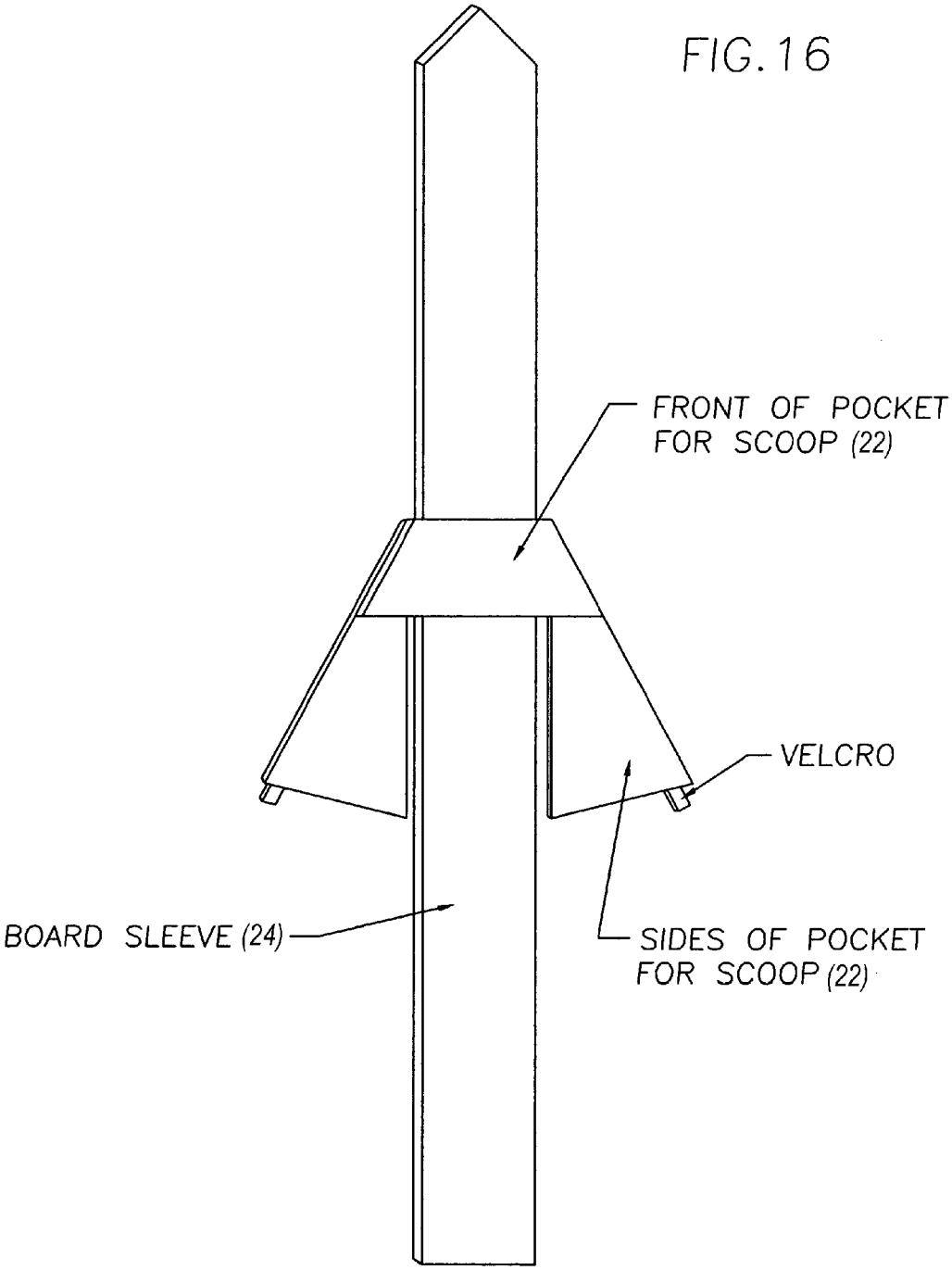
FIG. 16 is a top view of pocket for scoop attached to board sleeve, Velcro is shown attached to the rear side sections of pocket for scoop, of present invention.

FIG. 16 show a top view of pocket for scoop 22 attached to board sleeve 24. Pocket for scoop 22 is where scoop 23 is temporarily held to apparatus. Pocket for scoop 22 is sealed to bottom of board sleeve 24 and pontoon 21. Pocket for scoop 22 has three sections, a front, and two identical side sections. Pocket for scoop 22 can be comprised of a fabric or reinforced vinyl material.

FIG. 16 shows where the front section of pocket for scoop 22 is attached to board sleeve 24. Comprising the pocket for scoop 22 is described here. The two front side sections of the pocket for scoop 22 are attached to the sides of the middle section. The outer side sections are then sealed to the bottom of pontoon 21. The outer side sections of pocket for scoop 22 are sealed parallel to pontoon 21 about one to two inches away from the outer edge of board sleeve 24. The very front section of pocket for scoop 22 is sealed to board sleeve 24 and pontoon 21. This creates the pocket for scoop 22. Pocket for scoop 22 is sealed directly to pontoon 21 and board sleeve 24. Pocket for scoop 22 can also be sealed to pontoon 21 in front of and in back of board sleeve 24.

The apparatus uses the invention named Velcro in certain locations on apparatus to be described. Velcro is a two part hook and loop invention with hooks on one strip and loops on other strip. Velcro can temporary hold two pieces of material together then be pulled apart. Pocket for scoop 22 has Velcro attached to its rear side sections. Scoops 23 have opposite part of Velcro securely attached to it. Scoop 23 and pocket for scoop 22 could also use any other type of fastening device, such as snaps, buttons, stretch cords or a combination of these fasteners.

Figure 15:
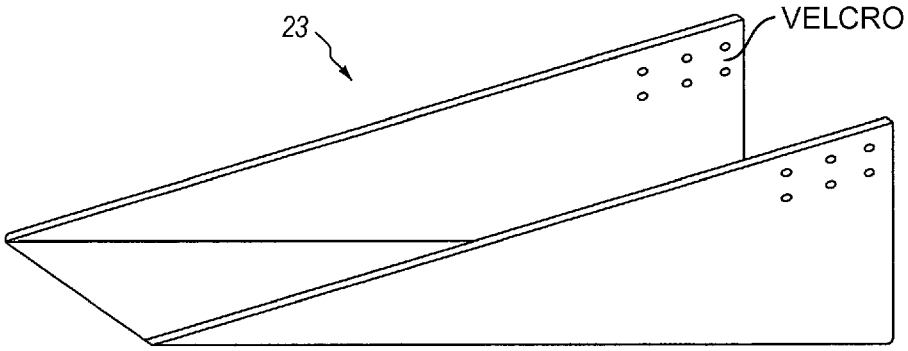
FIG. 15 is an upper side view of scoop with Velcro attached to inside of rear section of scoop, of present invention.

FIG. 16 shows pocket for scoop 22 with Velcro attached. FIG. 15 shows where Velcro is attached to scoop 23. Velcro is securely attached to rear outer section of pocket for scoop 22. FIG. 15 shows where second part of Velcro is attached to inside rear upper section of scoop 22. The Velcro holds scoop 23 into pocket for scoop 22. The front end of scoop 23 is held into front end of pocket for scoop 22 by pulling Velcro tightly together.

Scoop 23 can be comprised of plastic by an injection molding process. Scoop 23 can also be comprised of a metal or fiberglass. Scoops 23 pass over water freely when one pushes pontoon 21 forward. Scoops 23 drop into water when pushing opposite pontoon forward. Scoops 23 pass over the water freely when going forward. The sides of scoops 23 come up along the sides of pontoons 21 when walking on land. Scoops 23 automatically drop down into water when needed. This allows one to be able to walk from the land into the water. Scoops 23 are light weight and very durable. The dimensions for scoop 23 and pocket for scoop 22 can be many various sizes.

FIG. 18 shows a cross section view of pontoon 21, footwell 27, collar for footwell 28, and footwell supports. FIG. 18 also shows board sleeve 24 and support board 25. Board sleeve 24 is sealed from front to back at its sides to bottom of pontoon 21. Board sleeve 24 is open at its rear section to allow support board 25 to enter into board sleeve 24.

Board sleeve 24 allows support board 25 to enter from rear end of board sleeve 24. Support board 25 is inserted into board sleeve 24 before pontoon 21 is inflated. Board sleeve 24 holds support board 25 when pontoon 21 is inflated. Board sleeve 24 can be comprised of the same material as pontoon 21. Board sleeve 24 is slightly larger than support board 25. Support board 25 is inserted into board sleeve 24. Board sleeve 24 is also attached to cover 37 as described earlier. Support board 25 is centered directly below footwell 27.

FIG. 16 shows a top view of board sleeve 24 along with pocket for scoop 22. Board sleeve 24 is slightly larger than support board 25. This allows for board sleeve 24 to be able to hold support board 25.

Figure 17:
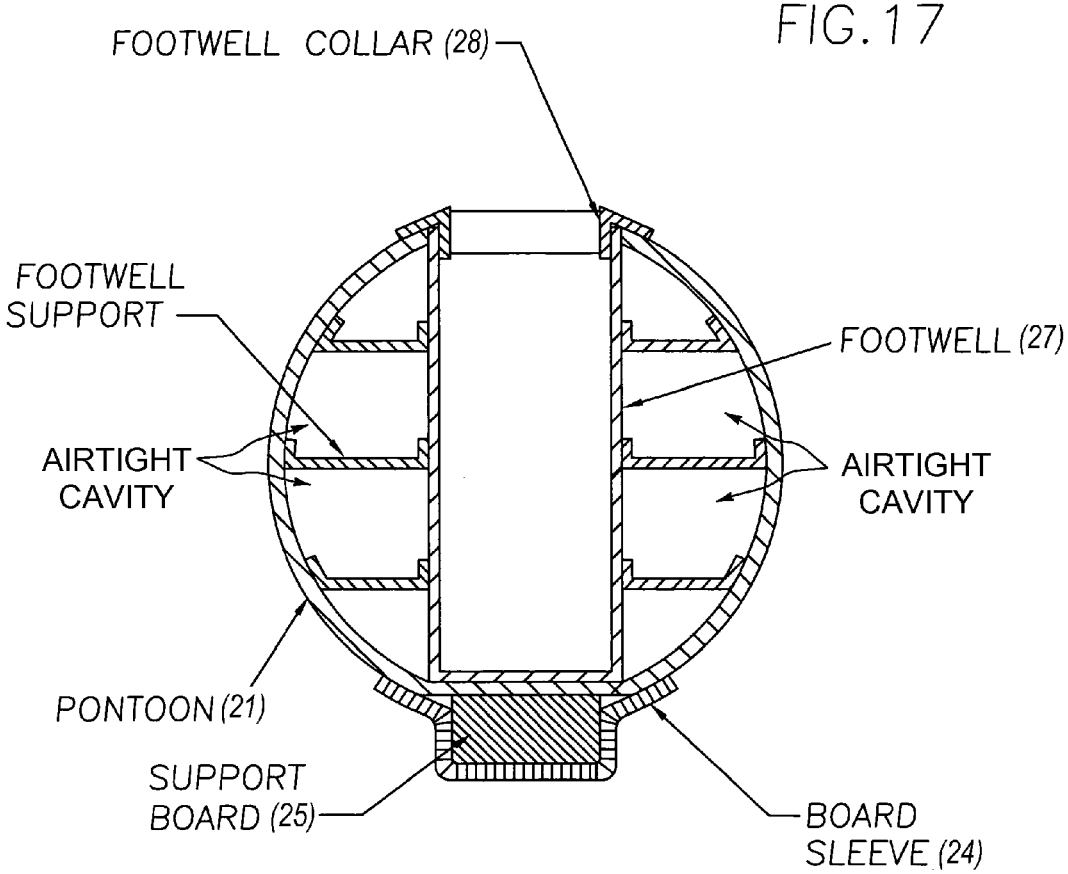
FIG. 17 shows a cross cut through section of pontoon, with footwell and footwell supports, footwell collar, board sleeve, support board, of present invention.

FIG. 17 shows a top side view of support board. Support board 25 can be comprised out of wood, plastic, steel, aluminum, fiberglass, or any combination of these materials. Board sleeve 24 and support board 25 can also be longer or shorter. Support board 25 is inserted into board sleeve 24 before pontoons 21 are inflated. Board sleeve 24 is pulled tight against support board 25 when pontoon 21 is inflated. Support board 25 has a hole at back end for a place to grab onto support board 25 to pull from support sleeve 24.

FIG. 18 shows cross section view of footwell 27, footwell supports, and collar for footwell 28. Footwell 27 has footwell supports. The footwell supports can be comprised of reinforced vinyl material that is heat sealed from footwell 27 to pontoon 21. Footwell 27 has an opening at its top large enough for one to step into and out of footwell 27 without getting their shoes getting caught inside footwell 27. Footwell 27 gets longer towards the front bottom, and is able to hold a large size foot. The footwell supports are a part of pontoon 21 and sealed to footwell 27. The footwell supports are sealed from the outer side walls of footwell 27 to the inner side walls of pontoon 21. Footwell 27 and footwell supports can be comprised of reinforced vinyl material, or a non-reinforced vinyl material.

Figure 5:
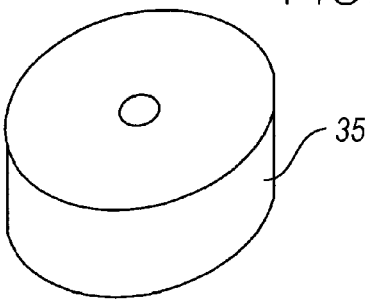
FIG. 5 is an upper side view of cap which screws onto neck of platform support, of present invention.

FIG. 5 shows collar for footwell 28. Collar for footwell 28 attaches from footwell 27 to pontoon 21. Collar for footwell 28 can be comprised of a vinyl material by an injection molding process.

Footwell 27 may also have the collar for footwell 28 comprised into footwell 27 by means of an injection molding process. This process would eliminate the collar for footwell 28.

Figure 13:
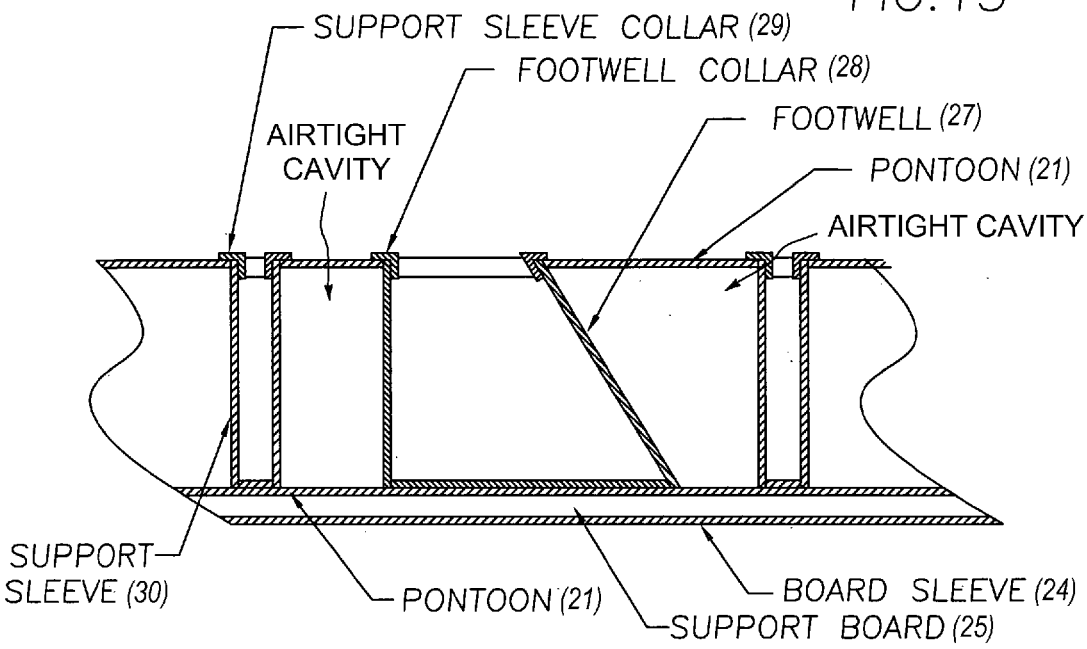
FIG. 13 shows a cross section side view of pontoon, support sleeves, and collars for support sleeves, footwell, and collar for footwell, board sleeve, and support board, of present invention.
Figure 14:
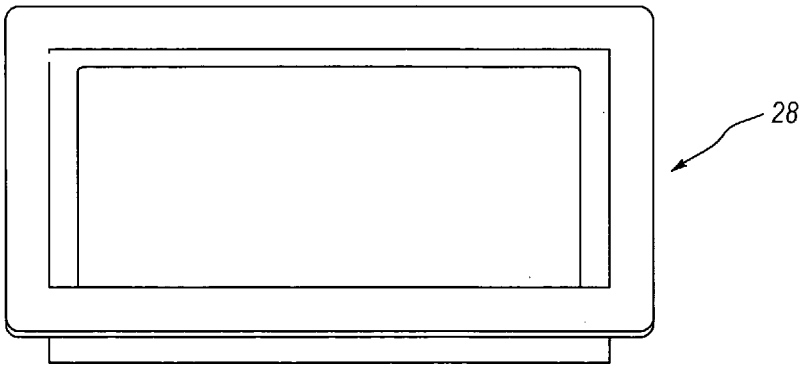
FIG. 14 is an upper side view of collar for footwell, of present invention.

FIG. 13 shows a cross section side view of pontoon 21, support sleeve 30, collar for support sleeve 29, footwell 27, and collar for footwell 28. It further shows where support board 25 is held to bottom of pontoon 21. The support sleeves 30 and footwell 27 are sealed off to the inside bottom of pontoon 21.

Support sleeve 30 may also have a collar comprised into it by means of an injection molding process, as described earlier with collar for footwell 27. This also would eliminate the collar for support sleeve 29.

Figure 7:
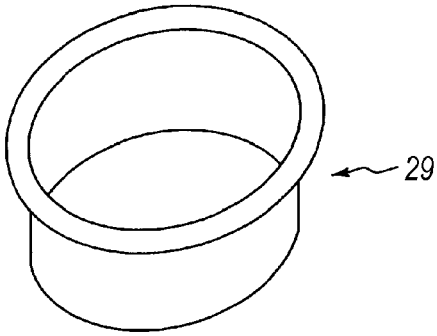
FIG. 7 is an upper side view of collar for the support sleeve, of present invention.

FIG. 7 shows collar for support sleeve 29. Collar for support sleeve 29 connects support sleeve 30 to pontoon 21. Collar for support sleeve 29 is sealed in between support sleeve 30 and Pontoon 21. Support sleeve 30 is sealed inside bottom of pontoon 21 with collar for support sleeve 29. Support sleeve 30 has collar for support sleeve 29 attached to its bottom before being sealed to bottom of pontoon 21. Collar for support sleeve 29 can also be used to seal the top of support sleeve 30. The collar for support sleeve 29 can be used to seal both the top and bottom of support sleeve.

Support sleeves 30 along with collar for support sleeve 29 are installed at holes at top of pontoon 21 for the support sleeves 30. Support sleeves 30 are open at their tops and sealed off to inside bottom of pontoon 21.

Support sleeves 30 can also be comprised to be sealed off at bottom, and a collar at its top. The support sleeve can be comprised to have collar molded to the top and sealed off at bottom by an injection molding process. This would illuminate collar for support sleeve 29 as described earlier.

Figure 8:
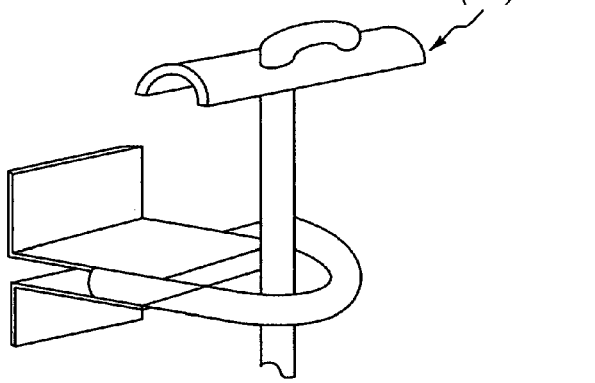
FIG. 8 is an upper front side view of button attached to stretch cord after being put through D-ring, of present invention.

Apparatus will use stretch cords through out to be described. Pontoons 21 are connected together at their front by a stretch cord. FIG. 8 shows how stretch cord is attached to button 26. Stretch cord is pushed up through first hole in bottom groove of button 26. Stretch cord is then pushed back through the top of second hole in button 26. A knot is then tied to end of stretch cord. Knot on Stretch cord is then pulled into groove of button 26. The groove holds knot of stretch cord into button 26. Button 26 can also be comprised with only one hole in the middle of button instead of two holes.

Pontoon 21 is comprised with D-rings securely attached to its side walls. The D-rings have a piece of reinforced vinyl material sealed over the straight part of D-ring to pontoon 21. This secures D-ring to Pontoon 21. Button 26 and stretch cord is held in place on pontoon 21 by D-ring. Button 26 has stretch cord attached to it and is put through D-ring on pontoon 21. Button 26 turns sideways and cannot come out of D-ring. Only with the assistance of the user will button 26 come out of D-ring. The D-rings are attached at the front and back of side walls of pontoon 21 as shown in FIG. 1.

Pontoons 21 are also connected at their rear by platform supports 32 as shown in FIG. 1 and FIG. 2. These figures show how platform 33 is connected to pontoons 21. Support tubes 31 are inserted into the support sleeves 30 of pontoon 21. Support tubes 31 are strong and comprised of plastic. The bottom edges of support tubes 31 are rounded off to prevent puncturing support sleeves 30. The legs of platform support 32 are dropped into the support tubes 31. Support tubes 31 hold legs of platform support 32 inside support tube 31. The legs of platform support 32 are held into and are able to rotate back and forth inside the support tubes 31. Support tubes 31 are slightly larger in diameter than legs of platform support 32. The support tubes 31 rise above pontoon 21 about one inch. This allows platform support 32 to move freely above pontoon 21.

Figure 3:
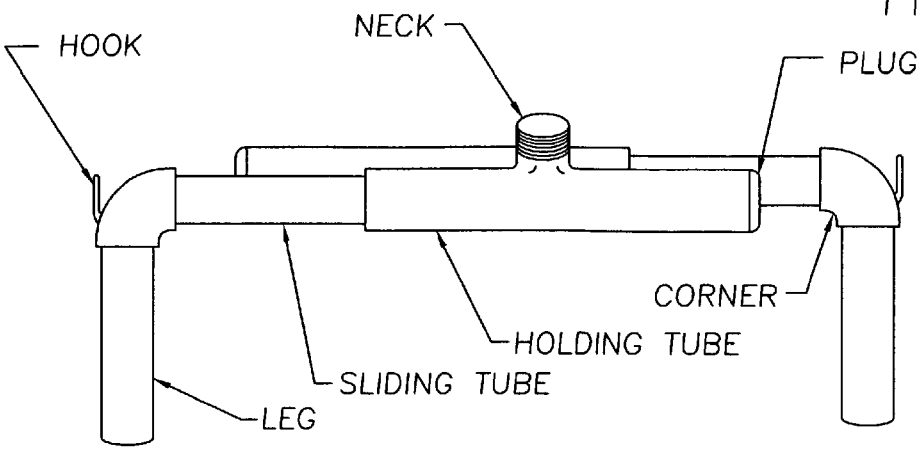
FIG. 3 is an upper side view of platform support partially extended showing neck, hook, plug, leg, sliding tube, holding tube, and corner, of present invention.
Figure 4:
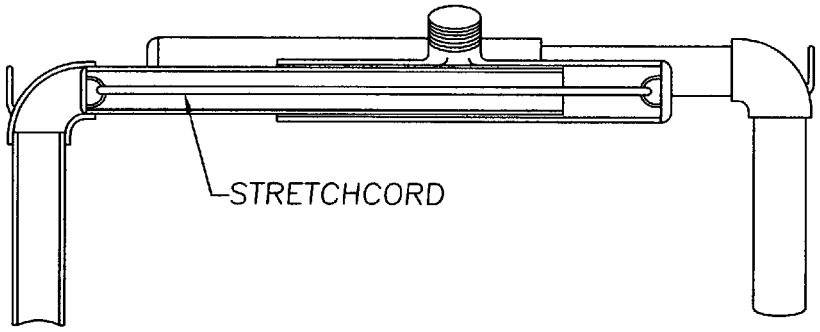
FIG. 4 shows a cut through upper side view of holding, and sliding tube, and of the platform support partially extended showing stretch cord inside the sliding, and holding tube of the platform support, of present invention.

FIG. 2, FIG. 3, and FIG. 4 shows platform support 32. The legs of platform support 32 drop into support tubes 31. The legs of platform support 32 rotate back and forth inside support tube 31. The platform support 32 is very strong and can be comprised of plastic, fiber glass, metal, or any combination of these materials. The corner of platform support 32 is attached to leg, and the sliding tube of platform support 32. Corner of platform support rests directly on top surface of support tube 31. This is where all weight above this point meets. Support tube 31 and corner of platform support 32 are same size where they meet. The support tube 31 keeps leg of platform support 32 centered exactly on top of support tube 31. The corner of platform support 32 rotates smoothly back and forth on top surface of support tube 31. The corner of platform support 32 can be comprised of plastic, fiber glass, or metal. Corner of platform support 32 is bonded to both sliding tube, and leg of platform support 32.

FIG. 3 and FIG. 4 shows corner having a hook molded to it, the hook holds the stretch loop 38 that is permanently attached to pontoon 21.

Figure 9:
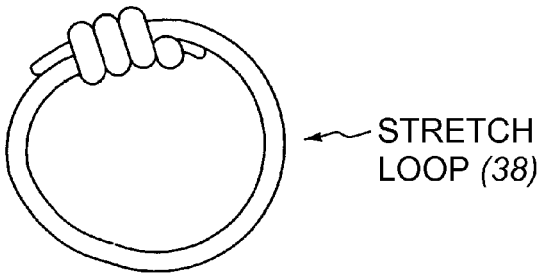
FIG. 9 is an upper view of stretch loop being held together at ends with wire, of present invention.

FIG. 9 shows a side view of stretch loop. Stretch loop 38 can be comprised by attaching the two ends of a stretch cord together creating a loop. Stretch loop 38 can also be comprised of a very strong high quality rubber band. Stretch loops 38 are attached to pontoon 21 by sealing a strap of reinforced vinyl material over a small area of stretch loop 38 to pontoon 21. This same method is used when attaching the D-rings to pontoon 21 as described earlier. Two stretch loops 38 are used on each hook of corner of the platform support 32, and attached to pontoon 21 about one inch below opening of support sleeve 30. Stretch loops 38 are attached on opposite sides of opening of support sleeve 30. This gives equal support on each side, holding down the platform support 32 into the support tubes 31. Stretch loops 38 are stretched up and released into hooks of corners. The stretch loops 38 would also be attached to cover 37 at their proper position as described earlier.

FIGS. 3 and 4 shows platform support 32. The holding and sliding tubes of platform support 32 can be comprised out of plastic, fiberglass, or metal. The sliding tubes of platform support 32 slide back and forth inside the holding tube. The holding tube enables the sliding tube to slide in and out of holding tube very smoothly. The holding and sliding tube enable platform support 32 to be able to expand and contract. The holding tube is comprised of two tubes molded together with neck of platform support 32 molded in between the two holding tubes at their center. The holding tubes can be comprised by an injection molding process for plastic material, or welding it together for metal applications. The two holding tubes are the same size and parallel with each other with ends apart.

FIGS. 3 and 4 shows platform support 32 partially extended. The neck of platform support 32 is between the holding tubes at its exact center, and is molded or welded onto the holding tubes. The neck of platform support 32 is threaded at its top for cap 35 to be screwed onto neck. The neck is where platform support 32 connects to platform 33.

Platform support 32 uses stretch cords to help pull the platform support 32 together. Stretch cords helps pull platform support 32 back together after being extended. FIG. 3 shows stretch cord tied at both ends to the plugs inside tubes of platform support 32. FIG. 3 shows where stretch cord is tied to plug at closed end of the holding tube, and where it is tied to plug inside sliding tube at opposite end.

Figure 6:
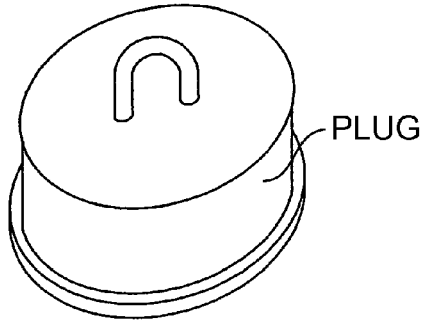
FIG. 6 is an upper side view of plug for holding, and sliding tube for the platform support, of present invention.

FIG. 6 shows an upper side view of plug. The plugs can be comprised of plastic or metal. The plug has a half ring extruding from its bottom side for the purpose of tying the stretch cords to plugs. The plug also has a collar on opposite side of ring on plug, this stops the plug from entering too far into sliding tube and holding tube. The plugs close off the holding tubes, and sliding tubes at their ends.

Figure 10:
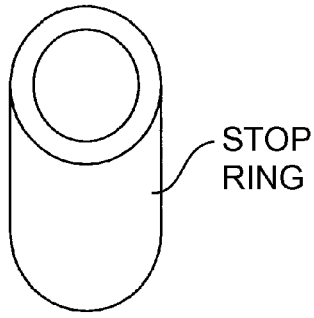
FIG. 10 is an upper view of stop ring which is attached to sliding tubes and holding tubes of the platform support, of present invention.

FIG. 10 shows an upper side view of stop ring for platform support 32. The stop ring is sealed to the ends of the holding, and sliding tubes of platform support 32.

FIG. 4 shows stop rings inside platform support 32 attached to the holding, and sliding tubes. The stop rings keep the holding, and sliding tubes from coming all the way apart. The first stop ring is sealed to the outside end of sliding tube before it is inserted into the holding tube. The second stop ring is then sealed to the inside opposite end where the plug is sealed to the holding tube. The stop rings are slightly different sizes, although they do butt up to each other which creates the holding, and sliding tubes to stop where they meet at the end of extension of the holding, and sliding tubes.

A rope can also be comprised into platform support 32 and tied to rings on plugs in the same matter as stretch cord, and also at the same time as stretch cord. The rope is used for the purpose of stopping the sliding tube at the exact extension length of platform support 32 which could illuminate the stop rings.

FIG. 3 shows where plugs are securely attached to inside ends of sliding tubes, and holding tubes. Two plugs are attached on the outside ends of the sliding tubes. And two plugs are attached on the inside of the opposite ends of the holding tube. The outside circumference of the plugs attached to the sliding tubes are slightly smaller than the inside circumference of the holding tube. This allows the sliding tube to slide smoothly through the holding tube. The sliding tubes slide in and out of the holding tube enabling platform support 32 to be able expand and contract. The sliding tubes are smaller in diameter than the holding tube this makes it so there are two different sizes of plugs. Sliding tubes will have smaller plugs and the holding tubes will have larger plugs.

FIG. 12 shows lower and upper compartments of platform 33. Two holes are centered at opposite ends in lower compartments of platform 33. The holes in the lower compartments of platform 33 are where the neck of platform support 32 enters up into platform 33. The holes in platform 33 keep platform 33 centered on platform support 32. The compartments inside platform 33 separate neck of platform support 32 and cap 35 from ladder 34. Ladder 34 is above in upper compartment of platform 33. The lower compartments hold and protect neck of platform support 32, and cap 35. Ladder 34 stays up off cap 35 and neck of platform support 32. This allows ladder 34 to go in and out of upper compartment of platform 33 unobstructed.

FIG. 5 shows cap 35. Cap 35 can be comprised of plastic by an injection molding process. Cap 35 can have a strap attached to it by using a screw or rivet. Caps 35 can be strapped into lower compartments of platform 33. The strap can be screwed or riveted from cap 35 into lower compartment of platform 33. Strap helps keep cap 35 from getting lost or falling in the water. Strap could be made out of nylon strapping or plastic. Cap 35 screws tightly onto neck of platform support 32. Cap 35 dose not screw tightly onto platform 33. Neck and cap 15 rotate freely inside lower compartments of platform 33. Cap 35 will not screw tightly onto platform 33. Although cap 35 dose screw tightly onto neck of platform support 32. Neck comes up into hole approximately one inch above surface of lower compartment. There is a slight gap between cap 35 and platform 34. Neck is slightly smaller than holes in lower compartments of platform 33. This allows for neck to rotate freely back and forth inside lower compartment.

FIG. 12 shows platform 33 open with two holes in lower compartments. The holes at bottom of platform 33 are lined up with support sleeves 30. This keeps platform 33 centered on top of pontoon 21. Platform 33 stays parallel with pontoon 21 at all times. Platform 33 stays parallel with pontoon 21 when walking on water.

Platform 33 gives one a place to sit while not walking on water. It could be very tiresome if one could not sit after walking and standing for long periods of time. Platform 33 makes it easier for one to stay out on the water for longer periods of time. Platform 33 holds ladder 34 inside of its upper compartment. Platform 33 can be comprised from Styrofoam, plastic, wood, metal, fiberglass, or any combination of these materials.

FIG. 12 shows a top rear view of ladder 34, lower, and upper compartments of platform 33. Platform 33 holds ladder 34 inside compartment of platform. Ladder 34 is for user to get into and out of water. The top hinge of ladder 34 is attached to back end of platform 33. Ladder 34 is wider at its top than bottom portion. The wider section at top of ladder 34 is for the purpose of pushing the pontoons apart, this allows for one to get in between the pontoons 21. Ladder 34 unfolds out of compartment of platform 33, and drops into the water.

Figure 11:
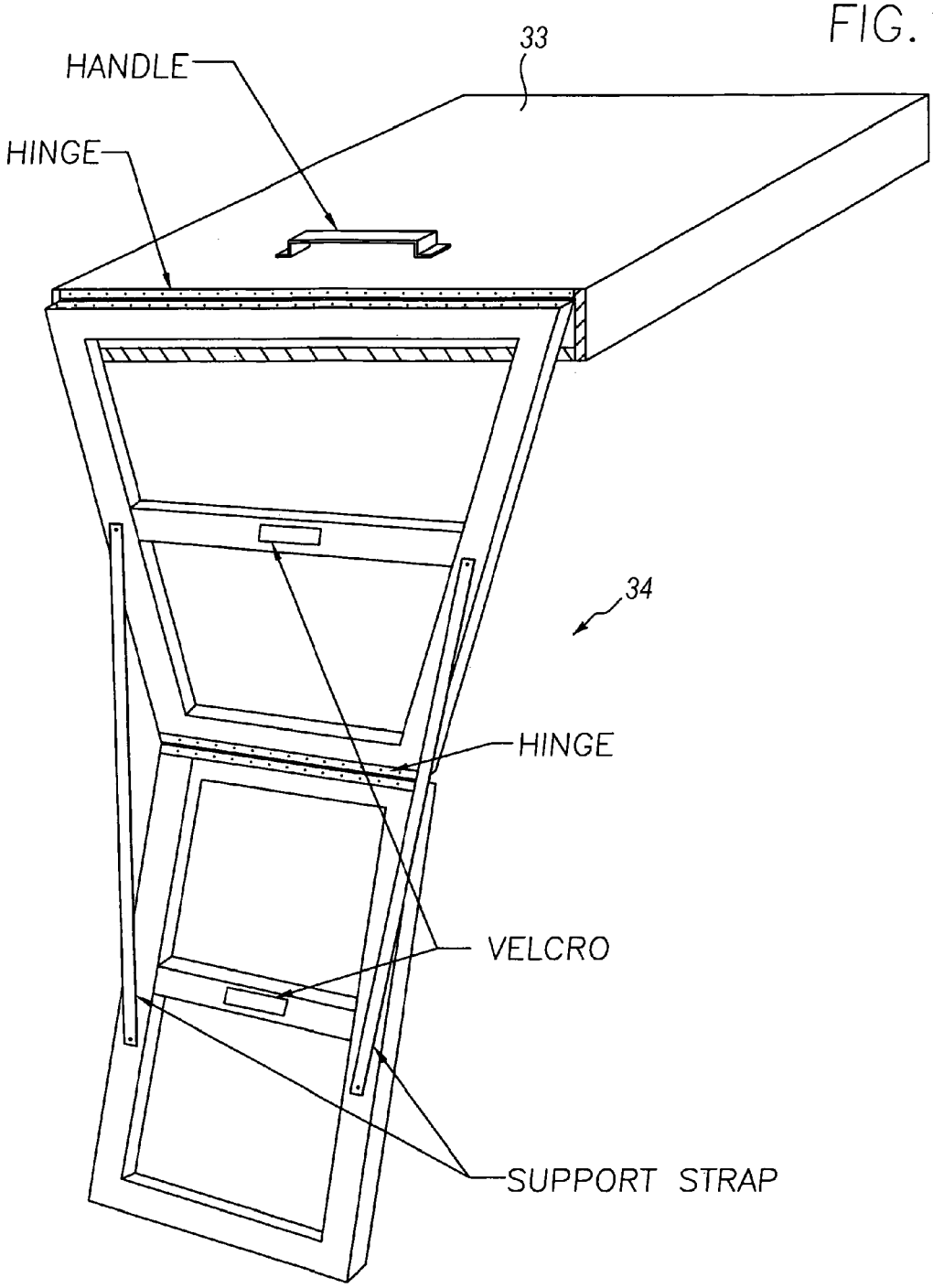
FIG. 11 is an upper rear view of ladder and platform when ladder is out of platform, it shows support straps, Velcro, hinges for ladder, and handle on top of platform, of present invention.

FIG. 11 shows ladder 34 out of platform 33. The top section of ladder 34 is wider than bottom section and pushes and holds apart pontoons 21 when ladder 34 is lowered into water. Pontoons 21 need to be apart for user to get in between them. The lower section of ladder 34 unfolds and drops into water. The straps and hinges support ladder 34 as shown in FIG. 11. The straps do not let ladder 34 unfold completely. The straps attached to ladder 34 prevent ladder 34 from completely unfolding. FIG. 11 shows how hinges on platform 33 and ladder 34 work. A hinge is at top section of ladder 34 and the rear top side of platform 33. Hinges enables ladder 34 to be folded into and out of platform 33. Hinges enables ladder 34 to hang from back side of platform 33 into water. Hinge in the middle of ladder 34 enables ladder to fold and unfold. This hinge makes ladder 34 twice as long.

FIG. 11 shows ladder 34 when out of platform and the straps connected from the lower half to upper half of ladder 34. Straps can be made from nylon strapping material. Velcro is attached to middle sections of second and third step of ladder 34. Velcro can be used to hold the two sections of ladder 34 together. A catch could also be used here holding ladder 34 together for easy removal of ladder 34 from platform 33. The Velcro and catch is for the purpose of holding ladder together when removing ladder 34 from platform 33 making it easier to take ladder out of platform.

FIG. 1 shows platform 33 with a handle on top section. Handle could be screwed, or riveted to top section of platform 33. The handle can be made out of nylon strapping, reinforced vinyl material, or plasticl. The handle is for assisting of lifting the top section of platform 33. The platform 33 could also have a hole here for a place to grab on to which would act as handle. Platform 33 could also have another handle attached to front side of platform 33. This handle would be used for carrying platform. These handles on the platform 33 could make the apparatus more convenient to use.

FIG. 1 shows holder 36. Holder 36 holds articles such as fishing poles, fishing gear, tools or paddles. Holder 36 can be comprised of a stretch material with vinyl material sewn to ends. The vinyl material is then heat sealed to pontoon 21. Holder 36 can also be comprised of a solid piece of non-reinforced vinyl material. The material of holder 36 is very strong, pliable, and stretchable.

Holder 36 can hold many different articles making holder 36 very useful. Holder 36 can also be put on horizontally to pontoon 21. Holders 36 can also be attached to cover 37. Holder 36 enables one to bring articles that one could not carry in ones hands. Holder 36 could also hold bags that are specially designed for apparatus. The bags could hold snacks, drinks, tools, or anything that would fit in them.

I claim:

1. An apparatus used for walking and resting on water comprising:

two inflatable pontoons each having a top and bottom surface with respective holes on the top surface for a footwell and for a plurality of platform support sleeves, the footwell extending longitudinally lengthwise along a portion of each respective pontoon, and each footwell being defined by side walls extending vertically downward into each respective pontoon so as to receive a respective foot of a user into the footwell during use;

a plurality of footwell supports sealed perpendicular to the side walls of the footwell so as to extend between an inside surface of the side wall and an inside surface of the pontoon, the footwell supports being disposed within the pontoon to either side of the footwell, below a top of the hole for the footwell in the top surface of the pontoon;

a plurality of D-rings sealed to the outside side walls of each pontoon for the purpose of attaching a stretch cord in between the two pontoons, a platform support that expands and contracts when in use so as to accommodate variable spacing between the pontoons while connecting the pontoons together, the platform support comprising a horizontal sliding tube received within a horizontal holding tube, the sliding tube withdrawing from the holding tube as the pontoons are moved apart and the sliding tube advancing within the holding tube as the pontoons are moved towards one another so that the platform support is automatically adjustable in width to accommodate a variable distance between the pontoons;

a platform including a top, and bottom, with lower and upper compartments, wherein a top section of the platform opens and closes with the assistance of a user, so as to allow a user to sit on the platform; and wherein each platform support further comprises a neck and a cap, an underside of the platform comprising corresponding holes which are the lower compartment into which a neck and cap of a corresponding platform support are received so as to hold down and secure the platform to the platform supports while allowing the platform to ride freely above the platform supports as the neck and cap rotate freely within the lower compartment of the platform.

2. The apparatus according to claim 1 wherein the footwell for each of the pontoons is open and sealed at the top to the respective pontoon, and closed off and sealed at an inside bottom to the respective pontoon, wherein each footwell is longitudinally longer at the bottom than the open top so as to accommodate a user's foot and allow one to step into and out of each footwell freely.

3. The apparatus according to claim 1 further comprising a collar for each footwell, each collar sealing the footwell to its respective hole for each footwell at the top of the pontoon so as to create an airtight cavity in the pontoon adjacent each footwell.

4. The apparatus according to claim 1 further comprising a support sleeve sealed from the inside bottom of the pontoon to the hole at the top of the pontoon for the support sleeve.

5. The apparatus according to claim 4 further comprising a collar for the support sleeve, the collar for the support sleeve connecting and sealing in between the support sleeve and the pontoon so as to create an airtight cavity in the pontoon adjacent each support sleeve.

6. The apparatus according to claim 1 further comprising a pocket for a scoop attached at the bottom of the pontoon, the pocket comprising vinyl, or a reinforced vinyl material, the pocket comprising a fastening device attached to the pocket for securing a scoop.

7. The apparatus according to claim 6, further comprising a scoop, the scoop being held in the pocket for the scoop by connecting the fastening device from the pocket for the scoop to a fastening device that is attached to the scoop such that the scoop creates resistance for the apparatus from going backwards.

8. The apparatus according to claim 1 further comprising a board sleeve comprised of at least one of a vinyl or reinforced vinyl material.

9. The apparatus according to claim 1 further comprising a support board disposed beneath each pontoon, the support boards being comprised of wood, plastic, metal, fiberglass, or any combination thereof so as to give the pontoons rigidity when a user steps into the footwells.

10. The apparatus according to claim 1 further comprising a support tube wherein the support tube holds and transfers weight from the top of the apparatus to the bottom of the apparatus.

11. The apparatus according to claim 1 further comprising stretch loops that are securely attached to the pontoons, two stretch loops at each opening of the support sleeve, one on each side of the support sleeve, so that the stretch loops hold down the platform supports into the support tubes while the apparatus is in use, and wherein the stretch loops comprise a rubber band or stretch cord material.

12. The apparatus according to claim 1 further comprising a holder comprised of a stretch fabric material with vinyl material attached to its ends, the vinyl material being sealed to side walls of the pontoon to allow one to insert articles in between the pontoon and the stretch fabric.

13. The apparatus according to claim 1 further comprising a stretch cord inside the sliding tube and the holding tube, the stretch cord extending from one end of the holding tube to an opposed end of the sliding tube so as to pull the sliding tube and the holding tube of the platform support together.

14. An apparatus used for walking and resting on water comprising:

two inflatable pontoons each having a top and bottom surface with respective holes on the top surface for a footwell and for a plurality of platform support sleeves, the footwell extending longitudinally lengthwise along a portion of each respective pontoon, and each footwell being defined by side walls extending vertically downward into each respective pontoon so as to receive a respective foot of a user into the footwell during use;

a plurality of footwell supports sealed perpendicular to the side walls of the footwell so as to extend between an inside surface of the side wall and an inside surface of the pontoon, the footwell supports being disposed within the pontoon to either side of the footwell, below a top of the hole for the footwell in the top surface of the pontoon;

a plurality of D-rings sealed to the outside side walls of each pontoon for the purpose of attaching a stretch cord in between the two pontoons;

a platform support that expands and contracts when in use so as to accommodate variable spacing between the pontoons while connecting the pontoons together, the platform support comprising a horizontal sliding tube received within a horizontal holding tube, the sliding tube withdrawing from the holding tube as the pontoons are moved apart and the sliding tube advancing within the holding tube as the pontoons are moved towards one another so that the platform support is automatically adjustable in width to accommodate a variable distance between the pontoons;

a platform including a top, and bottom, with lower and upper compartments, wherein a top section of the platform opens and closes with the assistance of a user, so as to allow a user to sit on the platform; and a ladder that securely attaches to an inside of the upper compartment of the platform with hinges, the ladder unfolding out of the platform and dropping down into water, the ladder comprising straps extending between an upper section and a lower section of the ladder to prevent the ladder from unfolding completely, the ladder assisting a user to get back on the platform if a user was to fall into the water.

15. The apparatus according to claim 14 wherein a width of the ladder is greater across the upper section of the ladder than the lower section of the ladder to force the pontoons apart, allowing one to climb out of water onto the platforms between the pontoons.

16. An apparatus used for walking and resting on water comprising:

two inflatable pontoons, each having a top surface and a bottom surface with a footwell hole disposed in the top surface, the footwell hole extending longitudinally lengthwise along a portion of each respective pontoon, each footwell being defined by a front wall, a back wall, and opposed side walls disposed therebetween, the side walls extending vertically downward from the top surface of the pontoon into each respective pontoon so as to receive a foot of a user into the footwell during use;

a plurality of footwell supports disposed one above another, spaced apart, and sealed generally perpendicular to the side walls of the foot well so as to extend between an inside surface of the side wall and an inside surface of the respective pontoon, the footwell supports being disposed within the pontoon to either side of the footwell, below a top of the footwell hole;

a plurality of platform support sleeve holes disposed in the top surface of each respective pontoon, the platform support sleeve holes extending generally vertically downward into the pontoon, the platform support sleeve holes being bounded by corresponding platform support sleeves;

a plurality of support tubes disposed within corresponding support sleeves;

a plurality of platform supports that automatically adjust in width to accommodate variable spacing between the pontoons while connecting the pontoons together, the platform supports each comprising a generally horizontal sliding tube received within a generally horizontal holding tube, the sliding tube withdrawing from the holding tube as the pontoons are moved apart and the sliding tube advancing within the holding tube as the pontoons are moved towards one another so that the platform support is automatically adjustable in width to accommodate a variable distance between the pontoons;

the platform supports each including an upwardly extending neck;

a platform disposed on the platform supports to allow a user to sit on the platform, the platform including upper and lower compartments, the lower compartment including corresponding holes into which the necks of the platforms supports are received so that the platform rides freely above the platform supports as the neck rotates freely within the corresponding hole in the lower compartment of the platform; and a ladder securely attached to an inside of the upper compartment by a hinge, the ladder unfolding out of the platform and dropping down into water, the ladder having a width that is greater across an upper section of the ladder than a lower section of the ladder to force the pontoons apart when the ladder is deployed in water, allowing a user to climb out of water onto the platform between the pontoons if a user was to fall into the water.

* * * * *

UNITED STATES PATENT AND TRADEMARK OFFICE

CERTIFICATE OF CORRECTION

PATENT NO. : 8,641,465 B2
APPLICATION NO. : 12/930647
DATED : February 4, 2014
INVENTOR(S) : Souter It is certified that error appears in the above-identified patent and that said Letters Patent is hereby corrected as shown below:

In the Specification

Column 2
Line 51, change "view of, apparatus" to --view of an apparatus--

Column 4
Line 46, change "can temporary hold" to --can temporarily hold--

Column 6
Line 18, change "through out" to --throughout--

Column 7
Line 44, change "cords helps" to --cords help--

Column 8
Line 4, change "in the same matter as" to --in the same manner as--
Line 45, change "cap 15" to --cap 35--
Line 47, change "33. Although cap 35 dose" to --33, although cap 35 does--

Column 9
Line 38, change "plasticl" to --plastic--

Signed and Sealed this
Ninth Day of June, 2015

Michelle K. Lee

Michelle K. Lee
*Director of the United States Patent and Trademark Office*